US009534188B2

(12) United States Patent
Kaneshige et al.

(10) Patent No.: US 9,534,188 B2
(45) Date of Patent: Jan. 3, 2017

(54) LUBRICATING OIL COMPOSITION

(71) Applicant: Mitsui Chemicals, Inc., Minato-ku, Tokyo (JP)

(72) Inventors: Ryousuke Kaneshige, Kisarazu (JP); Shota Abe, Chiba (JP)

(73) Assignee: MITSUI CHEMICALS, INC., Tokyo (JP)

( * ) Notice: Subject to any disclaimer, the term of this patent is extended or adjusted under 35 U.S.C. 154(b) by 100 days.

(21) Appl. No.: 14/391,319

(22) PCT Filed: Apr. 3, 2013

(86) PCT No.: PCT/JP2013/060202

§ 371 (c)(1),
(2) Date: Oct. 8, 2014

(87) PCT Pub. No.: WO2013/154005

PCT Pub. Date: Oct. 17, 2013

(65) Prior Publication Data

US 2015/0080280 A1 Mar. 19, 2015

(30) Foreign Application Priority Data

Apr. 12, 2012 (JP) ..... 2012-091458

(51) Int. Cl.
*C10M 161/00* (2006.01)
*C10M 169/04* (2006.01)
*C10N 40/04* (2006.01)

(52) U.S. Cl.
CPC ..... *C10M 161/00* (2013.01); *C10M 169/04* (2013.01); *C10M 169/044* (2013.01); *C10M 2203/1006* (2013.01); *C10M 2203/1025* (2013.01); *C10M 2205/022* (2013.01); *C10M 2205/0225* (2013.01); *C10M 2205/0285* (2013.01); *C10M 2207/2805* (2013.01); *C10M 2207/2835* (2013.01); *C10M 2219/082* (2013.01); *C10N 2040/04* (2013.01); *C10N 2220/022* (2013.01); *C10N 2230/02* (2013.01); *C10N 2230/68* (2013.01); *C10N 2230/70* (2013.01); *C10N 2240/04* (2013.01); *C10N 2240/08* (2013.01)

(58) Field of Classification Search
CPC ..... C10N 2040/04; C10N 2240/04
USPC ..... 508/569, 591; 585/12
See application file for complete search history.

(56) References Cited

U.S. PATENT DOCUMENTS 3,901,932 A 8/1975 Tada et al.
3,909,432 A 9/1975 McGuire et al.
6,589,920 B2 * 7/2003 Okada ..... C10M 143/02 508/591
6,753,381 B2 * 6/2004 Mishra ..... C08L 23/0807 508/110
6,764,985 B2 * 7/2004 Okada ..... C08F 210/16 508/591
6,835,698 B2 * 12/2004 Egawa ..... C08F 210/16 508/591
7,022,766 B2 * 4/2006 Okada ..... C08F 210/16 508/591
7,622,433 B2 * 11/2009 Kaneshige ..... C10M 107/06 508/591
7,820,607 B2 * 10/2010 Matsuda ..... C08F 210/06 508/591
7,871,965 B2 * 1/2011 Buitrago ..... C10M 141/10 508/184
8,026,199 B2 9/2011 Matsui et al.
8,138,133 B2 * 3/2012 Suzuki ..... C10M 111/04 508/110
8,309,501 B2 * 11/2012 Kolb ..... C08F 210/06 508/241
8,410,035 B2 * 4/2013 Kaneshige ..... C10M 107/02 508/473
8,618,033 B2 * 12/2013 Kolb ..... C08F 10/00 508/591
8,865,633 B2 * 10/2014 MacPherson ..... C10M 161/00 508/459

(Continued)

FOREIGN PATENT DOCUMENTS

CN 1637125 A 7/2005
CN 101146899 A 3/2008
EP 1 528 098 A1 5/2005
EP 2 412 790 A1 2/2012
JP 2005-126709 A 5/2005
JP 2011-190377 A 9/2011
WO WO-00/34420 A1 6/2000

OTHER PUBLICATIONS

Office Action issued in Chinese Patent Application No. 201380019264.5 dated Jul. 29, 2015.

(Continued)

*Primary Examiner* — Ellen McAvoy
(74) *Attorney, Agent, or Firm* — Foley & Lardner LLP

(57) ABSTRACT

A lubricating oil composition comprising (A) an ethylene/α-olefin copolymer satisfying all of the following requirements (A-1) to (A-3): (A-1) an ethylene structural unit content of 30 to 70% by mol, (A-2) a kinematic viscosity at 100° C. of 20 to 3000 $mm^2/s$, and (A-3) Mw/Mn as measured by GPC of 1 to 2.5, (F) a sulfur-containing compound in which at least one hydrocarbon group adjacent to sulfur is a secondary or tertiary hydrocarbon group, and as an optional component, (G) an α-olefin polymer having 3 to 6 carbon atoms, and having a kinematic viscosity at 40° C. of 450 to 51,000 $mm^2/s$, a sulfur content of 0.1 to 5 parts by weight, and a component (G) content of 0 to 15 parts by weight. The lubricating oil composition is suitable particularly for gear oil and the like.

9 Claims, No Drawings

(56) References Cited

U.S. PATENT DOCUMENTS

| | | | |
|---|---|---|---|
| 9,115,328 | B2 | 8/2015 | Toda |
| 2002/0055445 | A1 | 5/2002 | Okada et al. |
| 2005/0090410 | A1 | 4/2005 | Devlin et al. |
| 2008/0110799 | A1 | 5/2008 | Matsui et al. |
| 2009/0023619 | A1 | 1/2009 | Kaneshige et al. |
| 2012/0040874 | A1 | 2/2012 | Toda |

OTHER PUBLICATIONS

International Search Report dated Jul. 9, 2013 issued in Application No. PCT/JP2013/060202.
An Extended European Search Report dated Dec. 2, 2015 issued in European Patent Application No. 13775585.6.

* cited by examiner

LUBRICATING OIL COMPOSITION

CROSS-REFERENCE TO RELATED PATENT APPLICATIONS

This application is the National Phase of PCT/JP2013/060202, filed Apr. 3, 2013, which claims priority to Japanese Application No. 2012-091458, filed Apr. 12, 2012, the entire contents of both being hereby incorporated by reference herein.

TECHNICAL FIELD

The present invention relates to a lubricating oil composition. More particularly, the present invention relates to a lubricating oil composition comprising specific components and mainly used for industrial machines and transportation machines.

BACKGROUND ART

In recent years, environmental problems have been highlighted on a global scale, and as one of countermeasures, reduction of power consumption or fuel consumption in industrial machines or transportation machines is taken in factories or by transportation carriers, etc. As one means to solve the above problems, there has been required a much higher effect on power saving and fuel saving by various lubricating oils used for the above machines.

Lubricating oil products have a so-called temperature dependence of viscosity that the viscosity generally greatly varies as the temperature is changed. Since the working temperature of equipment using lubricating oil greatly varies in certain cases, the temperature dependence of the viscosity is considered to be preferably small. Then, for the purpose of reducing the temperature dependence of the viscosity, a certain polymer that is soluble in a lubricating base oil has been used as a viscosity modifier for lubricating oils. In recent years, an α-olefin polymer has been widely used as such a viscosity modifier, and in order to further improve a property balance of lubricating oil, a variety of further improvements have been made (patent literature 1).

Such viscosity index improvers as above are generally used for maintaining a proper viscosity at high temperatures. On the other hand, under such circumstances that energy saving and resource saving have been strongly considered to be part of reduction of environmental burden, a viscosity modifier, which holds down viscosity increase particularly at low temperatures (is excellent in low-temperature characteristics) and is excellent also in durability, has been desired recently. In general lubricating oil applications, in order to obtain excellent low-temperature characteristics, control of a concentration of a polymer contained to the lowest is advantageous also from the economical viewpoint, and therefore, use of a polymer having a molecular weight as high as possible is known. However, an α-olefin polymer having a high molecular weight tends to be disadvantageous in terms of shear stability.

Particularly in gear oil applications among industrial lubricating oil applications, high durability (shear stability) has been required, and performance given in consideration of a balance between durability and viscosity characteristics has been desired. Further, of various lubricating oils, gear oils are used under particularly severe conditions, so that requirements for higher performance and longer life are strong, and also with regard to an extreme pressure agent that is a component exerting influence on formation of a stable oil film, further improvement in performance is desired.

As lubricating base oils, mineral oils are classified into three ranks of Groups (I) to (III), and further, poly-α-olefins (PAO) are classified as Group (IV) and the others are classified as Group (V) by the API classification. In various automotive lubricating oil applications, in order to cope with higher performance required and reduction of environmental burden, a ratio of use of Group (II) and Group (III) mineral oils or synthetic oils such as poly-α-olefins has increased though Group (I) mineral oils have been hitherto widely used. On the other hand, also in the industrial lubricating oil applications, long life and high durability are desired, and the aforesaid Group (III) mineral oils or poly-α-olefins have been used. Particularly in the recent industrial gear oils, shear stability is strongly desired as a main parameter of durability. It is difficult to meet the shear stability required herein by the use of conventional viscosity modifiers of high molecular weight type, so that α-olefin polymers of relatively low molecular weight, such as polybutene, have been used. However, there is room for improvement in viscosity characteristics of polybutene, particularly in sufficient fluidity thereof at low temperatures, depending upon the use applications.

CITATION LIST

Patent Literature

Patent literature 1: WO 00/34420 Pamphlet

SUMMARY OF INVENTION

Technical Problem

The aforesaid extreme pressure agent is a component that chemically reacts with, for example, a material for forming a frictional surface of a machine or the like and forms a pressure-resistant film on the frictional surface. Since the materials of such frictional surfaces are often metals, the extreme pressure agent tends to be a component of high polarity.

On the other hand, base oils of synthetic oils, such as poly-α-olefins, often have low polarity, and therefore, the industrial gear oil applications in which high viscosity is particularly required have faced a problem that such oils have bad compatibility with the extreme pressure agent of high polarity.

Accordingly, the problem to be solved by the present invention is to provide industrial lubricating oil, which is excellent in compatibility with an extreme pressure agent, is excellent in a balance between viscosity characteristics and shear stability and is excellent also in durability.

Solution to Problem

Under such circumstances as above, the present inventors have earnestly studied, and as a result, they have found that the above problem can be solved by combining one or more ethylene/α-olefin copolymers having an ethylene content, a viscosity and a molecular weight distribution within specific ranges and one or more synthetic oils and/or mineral oils having specific viscosity, viscosity index and pour point that are used when needed, with a specific extreme pressure agent. Thus, the present inventors have accomplished the present invention.

That is to say, the present invention is a lubricating oil composition comprising (A) an ethylene/α-olefin copolymer satisfying all of the following requirements (A-1) to (A-3):

(A-1) an ethylene structural unit content is 30 to 70% by mol, (A-2) a kinematic viscosity at 100° C. is 20 to 3000 $mm^2/s$, and (A-3) Mw/Mn as measured by GPC is 1 to 2.5, (F) a sulfur-containing compound in which at least one hydrocarbon group adjacent to sulfur is a secondary or tertiary hydrocarbon group, and as an optional component, (G) an α-olefin polymer having 3 to 6 carbon atoms, and having a kinematic viscosity at 40° C. of 450 to 51,000 $mm^2/s$, a sulfur content of 0.1 to 5 parts by weight, and a component (G) content of 0 to 15 parts by weight, with the proviso that the total amount of the lubricating oil composition is 100 parts by weight.

The lubricating oil composition of the present invention preferably comprises a component (B) satisfying all of the following requirements (B-1) to (B-3):

(B-1) a kinematic viscosity at 100° C. is 3 to 120 $mm^2/s$, (B-2) a viscosity index is not less than 90, and (B-3) a pour point is not higher than −10° C.

In the lubricating oil composition of the present invention, the component (B) is preferably synthetic oil (C) satisfying all of the following requirements (C-1) to (C-3):

(C-1) a kinematic viscosity at 100° C. is 20 to 120 $mm^2/s$, (C-2) a viscosity index is not less than 120, and (C-3) a pour point is not higher than −30° C.

In the lubricating oil composition of the present invention, the component (B) is preferably synthetic oil (D) satisfying all of the following requirements (D-1) to (D-3):

(D-1) a kinematic viscosity at 100° C. is 3 to 10 $mm^2/s$, (D-2) a viscosity index is not less than 120, and (D-3) a pour point is not higher than −40° C.

In the lubricating oil composition of the present invention, the component (B) is preferably mineral oil (E) satisfying all of the following requirements (E-1) to (E-3):

(E-1) a kinematic viscosity at 100° C. is 3 to 40 $mm^2/s$, (E-2) a viscosity index is not less than 90, and (E-3) a pour point is not higher than −10° C.

In the lubricating oil composition of the present invention, the component (C) and/or the component (D) is preferably synthetic oil comprising an α-olefin polymer of 8 to 20 carbon atoms and/or an ester compound.

In the lubricating oil composition of the present invention, the component (E) is preferably one or more mineral oils selected from Groups (I), (II) and (III) of the API classification.

In the lubricating oil composition of the present invention, a saturated hydrocarbon content based on the total amount of the components (A) to (E) is not less than 80% by weight.

In the present invention, the lubricating oil composition is preferably a gear oil composition.

Advantageous Effects of Invention

The lubricating oil composition of the present invention is excellent in compatibility though it contains a sulfur compound that is considered to be preferable as an extreme pressure agent, that is, the lubricating oil composition is in liquid form with excellent transparency and is excellent also in viscosity characteristics and shear stability. Therefore, this lubricating oil composition is a lubricating oil composition excellent in energy saving, resource saving, etc. On this account, the lubricating oil composition is preferable as industrial lubricating oil, particularly gear oil.

DESCRIPTION OF EMBODIMENTS

The lubricating oil composition of the present invention is characterized by comprising a specific ethylene/α-olefin copolymer (A) and a sulfur compound (F) satisfying specific requirements. The components are described below.

[Ethylene/α-Olefin Copolymer (A)]

The ethylene/α-olefin copolymer (A) in the present invention comprises an ethylene/α-olefin copolymer having such properties as described below, and can favorably control the viscosity of the lubricating oil composition.

[(A-1) Ethylene Structural Unit Content]

The ethylene content in the ethylene/α-olefin copolymer (A) is usually in the range of 30 to 70% by mol. From the viewpoint of a balance between viscosity characteristics and heat resistance, the ethylene content is preferably 40 to 70% by mol, more preferably 45 to 65% by mol.

The ethylene content in the ethylene/α-olefin copolymer (A) is measured by $^{13}C$-NMR method that is carried out under the later-described conditions, and in accordance with a method described in, for example, "Polymer Analysis Handbook" (Asakura Publishing Co., Ltd., pp. 163-170), identification of peaks and determination can be carried out.

Examples of α-olefins to constitute the ethylene/α-olefin copolymer (A) include α-olefins of 3 to 20 carbon atoms, such as propylene, butene-1, pentene-1, hexene-1, heptene-1, octene-1, decene-1, undecene-1, dodecene-1, tridecene-1, tetradecene-1, pentadecene-1, hexadecene-1, heptadecene-1, octadecene-1, nonadecene-1 and eicosene-1. In the ethylene/α-olefin copolymer (A), these α-olefins may be used in combination of two or more kinds. Of these α-olefins, α-olefins of 3 to 10 carbon atoms are preferable, and propylene is particularly preferable, from the viewpoint that they impart good viscosity characteristics, shear stability and heat resistance to the lubricating oil composition.

[(A-2) Kinematic Viscosity (100° C.)]

The kinematic viscosity (100° C.) of the ethylene/α-olefin copolymer (A) is in the range of 20 to 3000 $mm^2/s$, preferably 50 to 2500 $mm^2/s$, particularly preferably 80 to 2200 $mm^2/s$.

[(A-3) Molecular Weight Distribution (Mw/Mn)]

It is desirable that Mw/Mn (Mw: weight-average molecular weight, Mn: number-average molecular weight) of the ethylene/α-olefin copolymer (A), which is an index of a molecular weight distribution, is not more than 2.5, preferably not more than 2.4, more preferably not more than 2.2. If the molecular weight distribution exceeds 2.5, shear stability of the lubricating oil viscosity is lowered.

The ethylene/α-olefin copolymer (A) in the present invention can be produced by using publicly known processes without any restriction. For example, a process wherein copolymerizing ethylene and an α-olefin in the presence of a catalyst comprising a transition metal compound, such as vanadium, zirconium or titanium, and an organoaluminum compound (organoaluminum oxy-compound) and/or an ionizing ionic compound can be mentioned. Such a process is described in, for example, WO 00/34420 Pamphlet (patent literature 1).

For the ethylene/α-olefin copolymer in the present invention, two kinds of ethylene/α-olefin copolymers different in kinematic viscosity (100° C.) may be used in combination.

Of these, an ethylene/α-olefin copolymer (A1) having a relatively high kinematic viscosity preferably has a kinematic viscosity of 150 to 3000 $mm^2/s$, more preferably 300 to 2500 $mm^2/s$, still more preferably 500 to 2200 $mm^2/s$.

On the other hand, an ethylene/α-olefin copolymer (A2) having a relatively low kinematic viscosity preferably has a kinematic viscosity of 20 to 120 $mm^2/s$, more preferably 30 to 110 $mm^2/s$, still more preferably 40 to 100 $mm^2/s$.

Preferred ranges of the ethylene structural unit contents and the molecular weight distributions of the ethylene/α-olefin copolymers (A1) and (A2) are the same as those of the ethylene/α-olefin copolymer (A). The quantity ratio between the ethylene/α-olefin copolymers (A1) and (A2) can be arbitrarily changed as long as the requirements of the ethylene/α-olefin copolymer (A) are satisfied.

The lubricating oil composition comprising the ethylene/α-olefin copolymer for use in the present invention is excellent in a balance between viscosity characteristics and shear stability.

[Lubricating Base Oil]

In the present invention, other lubricating oil materials can be used, when needed. Preferably, a component (B) satisfying all of the following requirements (B-1) to (B-3) can be used.

(B-1) The kinematic viscosity at 100° C. is 3 to 120 $mm^2/s$, preferably 4 to 110 $mm^2/s$.

(B-2) The viscosity index is not less than 90, preferably not less than 95.

(B-3) The pour point is not higher than −10° C., preferably not higher than −15° C.

The component (B) is a component other than the ethylene/α-olefin copolymer (A) and the α-olefin polymer of 3 to 6 carbon atoms (G).

Preferred examples of such lubricating oil materials include synthetic oils and mineral oils, such as following components (C) to (E).

The mineral oil (E) that is used in the present invention when needed is known as a so-called lubricating base oil. Such lubricating base oils are regulated by the API (American Petroleum Institute) classification and are classified into groups. Properties of the lubricating base oils are set forth in Table 1.

Mineral oils as the lubricating base oils are generally used after they are subjected to refining step such as dewaxing, and they consist of three grades grouped based on the refining method.

TABLE 1

| Group | Type | Viscosity index*1 | Saturated hydrocarbon content *2 (vol %) | Sulfur content* 3 (% by weight) |
|---|---|---|---|---|
| (I)*4 | Mineral oil | 80-120 | <90 | >0.03 |
| (I) | Mineral oil | 80-120 | ≥90 | ≤0.03 |
| (III) | Mineral oil | ≥120 | ≥90 | ≤0.03 |
| (iv) | Poly-α-olefin | | | |
| (v) | Lubricating base oils other than those listed above | | | |

*1measured in accordance with ASTM D445 (JIS K2283)

*2: measured in accordance with ASTM D3238

* 3: measured in accordance with ASTM D4294 (JIS K2541)

*4mineral oils in which a saturated hydrocarbon content is less than 90 (vol %) and a sulfur content is less than 0.03% by weight, or a saturated hydrocarbon content is 90 (vol %) or higher and a sulfur content is more than 0.03% by weight are also included in group (I).

The mineral oil (E) is mineral oil having the following properties (E-1) to (E-3), and is preferably high-viscosity index mineral oil, which is obtained by refining through hydrocracking or the like and belongs to any one of Groups (I) to (III) of the API classification, preferably Group (III).

(E-1) The kinematic viscosity at 100° C. is 3 to 40 $mm^2/s$, preferably 5 to 35 $mm^2/s$.

(E-2) The viscosity index is not less than 90, preferably not less than 95.

(E-3) The pour point is not higher than −10° C., preferably not higher than −15° C.

The synthetic oil (D) that is used in the present invention when needed is synthetic oil having the following properties (D-1) to (D-3), and is preferably a poly-α-olefin (PAO) of a relatively low viscosity and/or a polyol ester, a fatty acid ester or the like.

(D-1) The kinematic viscosity at 100° C. is 3 to 10 $mm^2/s$, preferably 4 to 8 $mm^2/s$.

(D-2) The viscosity index is not less than 120, preferably not less than 125.

(D-3) The pour point is not higher than −40° C., preferably not higher than −50° C.

The poly-α-olefin (PAO) belonging to Group (IV) in Table 1 is a hydrocarbon polymer obtained by polymerizing an α-olefin of 8 or more carbon atoms as at least a raw material monomer, and includes, for example, polydecene obtained by polymerizing decene-1. Such a poly-α-olefin is a more preferred embodiment of the synthetic oil (D).

Such an α-olefin oligomer can be produced by cationic polymerization, thermal polymerization or radical polymerization using a Ziegler catalyst or a Lewis acid as a catalyst. As a matter of course, the α-olefin oligomer can be also obtained by polymerizing the corresponding olefin in the presence of the catalyst described in the aforesaid patent literature 1.

Examples of the base oils belonging to Group (V) in Table 1 include alkylbenzenes, alkylnaphthalenes and ester oils.

The alkylbenzenes or the alkylnaphthalenes are usually dialkylbenzenes or dialkylnaphthalenes, most of which have an alkyl chain length of 6 to 14 carbon atoms, and such alkylbenzenes or alkylnaphthalenes are produced by Friedel-Crafts alkylation reaction of benzene or naphthalene with an olefin. The alkylation olefin used in the production of alkylbenzenes or alkylnaphthalenes maybe a linear or branched olefin or a combination of these olefins. Such a production process is described in, for example, U.S. Pat. No. 3,909,432.

Examples of the esters include monoesters produced from monobasic acids and alcohols; diesters produced from dibasic acids and alcohols or from diols and monobasic acids or acid mixtures; and polyol esters produced by bringing diols, triols (e.g., trimethylolpropane), tetraols (e.g., pentaerythritol), hexaols (e.g., dipentaerythritol) or the like to react with monobasic acids or acid mixtures. Examples of these esters include tridecyl pelargonate, di-2-ethylhexyl adipate, di-2-ethylhexyl azelate, trimethylolpropane triheptanoate and pentaerythritol tetraheptanoate.

The synthetic oil (C) that is used in the present invention when needed is synthetic oil satisfying the following properties (C-1) to (C-3) and is preferably a poly-α-olefin (PAO) belonging to Group (IV), but it may contain synthetic oil such as an ester belonging to Group (V).

(C-1) The kinematic viscosity at 100° C. is 20 to 120 $mm^2/s$, preferably 30 to 110 $mm^2/s$.

(C-2) The viscosity index is not less than 120, preferably not less than 130.

(C-3) The pour point is not higher than −30° C., preferably not higher than −35° C.

The component (B) that is preferably used as a lubricating base oil of a low viscosity in the present invention comprises one or more kinds selected from the synthetic oils (C), the synthetic oils (D) or the mineral oils (E), and may comprise one or more kinds selected from the synthetic oils (C), the synthetic oils (D) and the mineral oils (E), or may be a mixture of the synthetic oil (C) or (D) and the mineral oil (E).

When the total amount of the ethylene/α-olefin copolymer (A) and the later-described sulfur compound (F) is 100 parts by weight, these components (B) to (E) can be used preferably in an amount of 2 to 80 parts by weight, more preferably 3 to 60 parts by weight, particularly preferably 4 to 40 parts by weight.

In the lubricating oil composition of the present invention, the saturated hydrocarbon content based on the total amount of the hydrocarbon components in the components (A) to (E) is preferably not less than 80% by weight, more preferably not less than 90%, still more preferably not less than 95%, particularly preferably not less than 96%.

If the saturated hydrocarbon content is too low, durability for lubricating oil sometimes becomes insufficient.

The α-olefin polymer of 3 to 6 carbon atoms (G), which is used in the present invention when needed, is an α-olefin polymer in which the amount of structural units of an α-olefin selected from α-olefins of 3 to 6 carbon atoms exceeds 70% by mol, and when the total amount of the lubricating oil composition is 100 parts by weight, the amount of the α-olefin polymer (G) is not more than 15 parts by weight, preferably not more than 12 parts by weight, more preferably not more than 10 parts by weight, still more preferably not more than 5 parts by weight, particularly preferably not more than 2 parts by weight. The lower limit is preferably 0 part by weight.

If the content of the α-olefin polymer of 3 to 6 carbon atoms (G) is too high, shear viscosity is sometimes lowered with time.

[Sulfur Compound (F)]

The sulfur compound (F) for use in the present invention is characterized in that the carbon atom adjacent to sulfur is secondary or tertiary carbon. Examples of substituents containing such carbon include isopropyl group (i-Pr), s-butyl group (s-Bu), t-butyl group (t-Bu), 2-hexyl group, 3-hexyl group, 2-methyl-2-pentyl group and 3-methyl-3-pentyl group.

The sulfur compound (F) having a substituent of such structures is generally used as an extreme pressure agent, and it is surprising that the sulfur compound has good compatibility with the ethylene/α-olefin copolymer (A) though it maintains strong polarity, and it can form a lubricating oil composition having excellent transparency. Further, compatibility of the sulfur compound (F) is rarely impaired even if various oil agents have high viscosity, and as the later-described lubricating oil composition, a product of high transparency tends to be easily obtained. It is thought that the coexistence of compatibility and polarity is derived from the structure of the above-described bulky hydrocarbon-containing substituent.

In the sulfur compound (F) for use in the present invention, the ratio of the number of carbon atoms to the number of sulfur atoms is preferably 1.5 to 20, more preferably 1.8 to 15, particularly preferably 2 to 10. It is thought that since the sulfur compound satisfying such a range has high polarity, it exhibits strong interaction with, for example, a surface of a gear of metal equipment and can form a strong coated film.

If the ratio of the number of atoms is too high, polarity sometimes becomes insufficient. On the other hand, if the ratio of the number of atoms is too low, compatibility of the sulfur compound with the ethylene/α-olefin copolymer (A) is sometimes lowered.

As a preferred example of such a sulfur compound as above, a compound of a structure wherein the aforesaid hydrocarbon substituents of a secondary or tertiary structure are present at both ends of a sulfur chain can be mentioned. Specific examples of such compounds include compounds having structures of t-$Bu_2$-S, s-$Bu_2$-S, i-$Pr_2$-S, t-Bu-S—S-t-Bu, s-Bu-S—S-s-Bu, i-Pr-S—S-i-Pr, t-Bu-S—S—S-t-Bu, s-Bu-S—S—S-s-Bu, i-Pr-S—S—S-i-Pr, t-Bu-S—S—S—S-t-Bu, s-Bu-S—S—S—S-s-Bu and i-Pr-S—S—S—S-i-Pr. (Here, Bu represents a butyl group, Pr represents a propyl group, s- represents secondary, and t- represents tertiary. As a matter of course, S is sulfur.)

When the total amount of the lubricating oil composition of the present invention is 100 parts by weight, the content of sulfur in the lubricating oil composition is 0.1 to 5 parts by weight, preferably 0.5 to 4 parts by weight, still more preferably 1 to 3 parts by weight.

When the above range is satisfied, transparency is imparted, and transparency and lubricating performance such as film formation can be allowed to coexist on a high level. If the content of sulfur is too low, lubricating oil performance sometimes becomes insufficient, and if the content of sulfur is too high, transparency for lubricating oil is sometimes impaired.

[Lubricating Oil Composition]

The lubricating oil composition of the present invention comprises the ethylene/α-olefin copolymer (A), and preferably comprises a component (B) comprising one or more kinds selected from the synthetic oil (C), the synthetic oil (D), the mineral oil (E) and the like, when needed. The lubricating oil composition of the present invention further comprises the sulfur compound (F). The ratio of these components contained is as previously described.

To the lubricating oil composition of the present invention, publicly known additives, such as pour point depressant, extreme pressure agent, friction modifier, oiliness agent, antioxidant, rust proofing agent and corrosion inhibitor, can be added in an amount of not more than 20 parts by weight based on 100 parts by weight of the composition, when needed.

Such a lubricating oil composition is characterized by exhibiting excellent viscosity characteristics and shear stability with a good balance.

[Pour Point Depressant]

Examples of the pour point depressants include a polymer or copolymer of alkyl methacrylate, a polymer or copolymer of alkyl acrylate, a polymer or copolymer of alkyl fumarate, a polymer or copolymer of alkyl maleate and an alkyl aromatic compound. Of these, a polymethacrylate pour point depressant that is a pour point depressant comprising a polymer or copolymer of alkyl methacrylate is particularly preferable. The number of carbons of the alkyl group in the alkyl methacrylate is preferably 12 to 20, and the content of the alkyl methacrylate is 0.05 to 2% by weight of the total amount of the composition. As such pour point depressants, products that are on the market as pour point depressants are obtainable. Examples of brand names of such commercial products include Aclube 146 and Aclube 136 available from Sanyo Chemical Industries, Ltd. and Lubran 141 and Lubran 171 available from Toho Chemical Industry Co., Ltd.

These components can be used by dissolving them in mineral oils, esters or the like or diluting them. The concentration is preferably 10 to 80%, more preferably 30 to 70%.

[Extreme Pressure Agent]

As the extreme pressure agents, not only the aforesaid sulfur compounds but also sulfurized olefins, sulfurized oils and fats, sulfides, phosphates, phosphites, phosphate amine salts and phosphite amine salts can be mentioned.

These components can be used by dissolving them in esters, solvents comprising the aforesaid olefin polymers or the like or diluting them. The concentration is preferably 10 to 80%, more preferably 30 to 70%.

[Friction Modifier]

As the friction modifiers, organometal-based friction modifiers, typically organomolybdenum compounds such as molybdenum dithiophosphate and molybdenum dithiocarbamate, can be mentioned.

These components can be used by dissolving them in esters or the like or diluting them. The concentration is preferably 10 to 80%, more preferably 30 to 70%.

Examples of the oiliness agents include fatty acids having an alkyl group of 8 to 22 carbon atoms, fatty acid esters and higher alcohols.

[Antioxidant]

Specific examples of the antioxidants include phenol-based antioxidants, such as 2,6-di-t-butyl-4-methylphenol; and amine-based antioxidants, such as dioctyldiphenylamine.

Examples of anti-foaming agents include silicon-based anti-foaming agents, such as dimethylsiloxane and silica gel dispersion; and alcohol- and ester-based anti-foaming agents.

These components can be used by dissolving them in esters or the like or diluting them. The concentration is preferably 10 to 80%, more preferably 30 to 70%.

[Rust Proofing Agent]

Examples of the rust proofing agents include carboxylic acids, carboxylates, esters and phosphoric acid. Examples of the corrosion inhibitors include benzotriazole, derivatives thereof and thiazole-based compounds.

Further, benzotriazole-based, thiadiazole-based and imidazole-based compounds can be also mentioned as the corrosion inhibitors.

The lubricating oil composition of the present invention is excellent particularly in viscosity characteristics and shear stability, and is effective as industrial lubricating oil.

The kinematic viscosity of the lubricating oil composition of the present invention at 40° C. is in the range of 450 to 51,000 $mm^2/s$. As industrial lubricating oil, the lubricating oil composition having a viscosity of ISO-500 to ISO-46,000 is preferable, and this is particularly effective as open type gear oil.

The lubricating oil composition of the present invention can be favorably used as industrial lubricating oil for various industrial machines and transportation machines. The lubricating oil composition of the present invention is favorable particularly for gear oil. Further, the lubricating oil composition of the present invention can be favorably used as gear oil for construction machines.

The lubricating oil composition of the present invention is expected to be excellent in film-forming ability on a metal surface, has high lubricating performance and can become lubricating oil having excellent transparency also at low temperatures. By using the lubricating oil composition continuously, its transparency tends to be gradually lowered, but conversely, the transparency can be regarded as an index of deterioration or time for replacement. On this account, transparency is also one of the important properties for lubricating oils.

EXAMPLES

The present invention will be further described with reference to the following examples. Various properties in the examples were measured in the following manner.

[Ethylene Content]

Using a JEOL LA500-model nuclear magnetic resonance spectrometer, the ethylene content was measured in a mixed solvent of orthodichlorobenzene and benzene-d6 (orthodichlorobenzene/benzene-d6=3/1 to 4/1 (ratio by volume)) under the conditions of 120° C., a pulse width of 45° pulse and a pulse repetition interval of 5.5 seconds. The number of repeated measurements is 1000 or more, preferably 10000 or more.

[Saturated Hydrocarbon Content]

An ECX400-model nuclear magnetic resonance spectrometer manufactured by JEOL Ltd. was used, and as a solvent, deuterated orthodichlorobenzene, deuterated chloroform or deuterated benzene was appropriately used.

A sample concentration of 50 to 60 mg/0.5 mL and a measuring temperature of room temperature to 120° C. were appropriately selected. Measurement was carried out under the conditions of an observed nucleus of $^1H$ (400 MHz), a single pulse sequence, a pulse width of 5.12 μsec (45° pulse), a repetition interval of 7.0 seconds, a cumulative number of 500 or more and a chemical shift reference value of 7.10 ppm. Peaks of $^1H$, etc. derived from vinyl group, methyl group and the like were assigned in the usually way, and using the result of the above ethylene content together, the saturated hydrocarbon content was calculated.

In the polyolefins (polymer A100, polymer A2000, NEXBASE 2006) used in the experimental examples of the present invention, peaks derived from unsaturated carbon-carbon bonds were rarely observed.

[Kinematic Viscosity (40° C., 100° C.)]

Measurement was carried out in accordance with ASTM D445. In the examples, the viscosity of a formulated oil was adjusted in the following manner on the basis of each ISO classification.

(1) ISO 460: A formulated oil was prepared by carrying out formulation so that the kinematic viscosity (40° C.) can be 460±46 $mm^2/s$.

(2) ISO 1000: A formulated oil was prepared by carrying out formulation so that the kinematic viscosity (40° C.) can be 1000±100 $mm^2/s$.

(3) ISO 2200: A formulated oil was prepared by carrying out formulation so that the kinematic viscosity (40° C.) can be 2200±220 $mm^2/s$.

(4) ISO 3200: A formulated oil was prepared by carrying out formulation so that the kinematic viscosity (40° C.) can be 3200±320 $mm^2/s$.

(5) ISO 4600: A formulated oil was prepared by carrying out formulation so that the kinematic viscosity (40° C.) can be 4600±460 $mm^2/s$.

(6) ISO 6800: A formulated oil was prepared by carrying out formulation so that the kinematic viscosity (40° C.) can be 6800±680 $mm^2/s$.

(7) ISO 10000: A formulated oil was prepared by carrying out formulation so that the kinematic viscosity (40° C.) can be 10000±1000 $mm^2/s$.

(8) ISO 22000: A formulated oil was prepared by carrying out formulation so that the kinematic viscosity (40° C.) can be 22000±2200 $mm^2/s$.

[Molecular Weight Distribution (Mw/Mn)]

A pump for liquid chromatography, a sampling apparatus, columns for gel permeation chromatography (GPC) and a differential refractive index detector (RI detector) described below were connected, and GPC measurement was carried out to determine a molecular weight distribution.

Liquid chromatography apparatus: 515 HPLC Pump manufactured by Waters Corporation Sampling apparatus: 717 plus Autosampler manufactured by Waters Corporation Mobile phase: THF (containing stabilizer, grade for liquid chromatography)

Column: One column of MIXED-D manufactured by Polymer Laboratories Ltd. and one column of 500 Å manufactured by Polymer Laboratories Ltd. were connected in series.

Sample concentration: 5 mg/mL

Mobile phase flow rate: 1.0 mL/min

Measuring temperature: ordinary temperature

Standard sample for calibration curve: EasiCal PS-1 manufactured by Polymer Laboratories Ltd.

[Shear Stability (Viscosity Reduction Rate %)]

Using a KRL shearing test machine, test was carried out in accordance with CEC-L-45 (CEC: an organization for the management of test procedure for the performance testing of automotive fuels & lubricants in Europe) to evaluate a reduction rate of viscosity at 40° C.

Shear stability is an index of kinematic viscosity loss attributable to cleavage of a molecular chain caused by that a copolymer component in lubricating oil suffers shear at the metal sliding part.

[Compatibility (Solubility of Extreme Pressure Agent)]

10 days after the compounded oil was heated and stirred at a temperature of 60° C., appearance of the oil was observed and evaluated by the following grades.

grade ○: transparent, grade Δ: slightly turbid, grade x: turbid

[Analysis of Extreme Pressure Agent (GC/MS Method)]

The structure of a sulfur compound contained in an extreme pressure agent was measured by a so-called GC/MS method using gas chromatography and a mass spectrometer in combination. The measuring conditions are described below.

Apparatus: Jms-Q1000GC K9 type apparatus manufactured by JEOL Ltd.

Column: DB5MS+DG (inner diameter: 0.25 mm, length: 30 m)

Column temperature control pattern: The temperature was maintained at 40° C. for 3 minutes and raised at a rate of 10° C./min, and after the temperature reached 320° C., this temperature was maintained for 29 minutes to complete the temperature control.

Mobile phase: helium (flow rate: 0.7 ml/min)

Sample injection temperature: 280° C., split (1/20)

Sample injection quantity: 1 μL (diluting solvent: hexane)

Ionization method: EI (electron ionization), ionization temperature: 200° C.

[Components Used in the Present Invention]

Components used in the examples and the comparative examples, such as lubricating base oils, are set forth in Table 2.

TABLE 2

| | Note on Component (Main Component) | Viscosity 100° C. ($mm^2/s$) | Viscosity 40° C. ($mm^2/s$) | Viscosity Index | Pour Point (° C.) |
|---|---|---|---|---|---|
| Chevron NEXBASE 2006 | polydecene (saturation ratio ~100%) | 5.83 | 30.5 | 137 | −65.0 |
| BFS TMTC | polyol ester | 4.40 | 19.5 | 140 | −50.0 |
| JX bright stock N460 | mineral oil (API Group I) | 29.9 | 460 | 97 | −10.0 |
| JX HV1900 | polybutene (main component) | 3950 | | | |
| UNICHEMA PRIOLUBE 3986 | polyol ester | 2030 | 54900 | 264 | |
| Shell Chemicals SV251 | Viscosity modifier | 1480 | 15500 | 346 | |

Extreme pressure agents used in the examples and the comparative examples are as follows.

HITEC (trademark)-3339 available from Afton Chemical Corporation sulfur content: 32.6% by weight, phosphorus content: 1.19% by weight (catalogue values)

As a sulfur-containing component, di-t-butyl polysulfide was detected by the GC/MS method. In addition, a component suggesting mineral oil was contained.

HITEC (trademark) 343 available from Afton Chemical Corporation

A peak suggesting a sulfur compound having a secondary or tertiary alkyl group was not detected by the GC/MS method.

[Polymerization Process]

Polymerization Example 1

In a continuous polymerization reactor having a volume of 2 liters, equipped with a stirring blade and having been thoroughly purged with nitrogen, 1 liter of dehydrated and purified hexane was placed, and a hexane solution of ethylaluminum sesquichloride ($Al(C2H5)_{1.5}.Cl_{1.5}$) having been adjusted to 96 mml/L was continuously fed for 1 hour at a feed rate of 500 ml/h. Thereafter, to the reactor were further continuously fed a hexane solution of $VO(OC_2H_5)Cl_2$ having been adjusted to 16 mmol/l, as a catalyst, at a feed rate of 500 ml/h and hexane at a feed rate of 500 ml/h. On the other hand, a polymerization mixture was continuously drawn out from the upper part of the polymerization reactor so that the amount of the polymerization mixture in the reactor might become always 1 liter. Next, using bubbling tubes, ethylene gas was fed at a feed rate of 35 L/h, propylene gas was fed at a feed rate of 35 L/h, and hydrogen gas was fed at a feed rate of 80 L/h. Copolymerization reaction was carried out at 35° C. by circulating a cooling medium through a jacket provided outside the polymerization reactor.

By carrying out the reaction under the above conditions, a polymerization mixture containing an ethylene/propylene copolymer was obtained. The resulting polymerization mixture was deashed with hydrochloric acid and then introduced into a large amount of methanol to precipitate the ethylene/propylene copolymer. Thereafter, the precipitate was subjected to vacuum drying at 130° C. for 24 hours. The results of analysis of the resulting polymer (polymer A-100) are set forth in Table 3.

Polymerization Example 2

A polymer A-2000 was obtained in the same manner as in Polymerization Example 1, except that the feed rates of ethylene gas, propylene gas and hydrogen gas were changed to 47 L/h, 47 L/h and 20 L/h, respectively. The results of analysis of the resulting polymer are set forth in Table 3.

TABLE 3

| | Polymerization Example 1 | Polymerization Example 2 |
|---|---|---|
| Ethylene content (mol %) | 53.9 | 55.9 |
| Propylene content (mol %) | 46.1 | 44.1 |
| Kinematic viscosity (100° C.) $mm^2/s$ | 100 | 2040 |
| Molecular weight distribution (Mw/Mn) | 1.65 | 1.77 |

Example 1

Using 93.0% by weight of the copolymer obtained in Polymerization Example 1 as the ethylene/propylene copolymer (A) serving as a viscosity modifier, 5.0% by weight of a polyol ester (TMTC available from BFS) classified as API Group (V) and 2.0% by weight of an extreme pressure agent HITEC (trademark)-3339 (available from Afton Chemical Corporation), formulation was carried out to prepare a formulated oil having a viscosity equivalent to ISO 1000. Lubricating oil properties of the formulated oil are set forth in Table 4.

Example 2

Using 9.5% by weight of the ethylene/propylene copolymer obtained in Polymerization Example 2 and 83.5% by weight of the copolymer obtained in Polymerization Example 1 as the ethylene/propylene copolymers (A), 5.0% by weight of a polyol ester (TMTC available from BFS) as the synthetic oil (C) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 4.

Example 3

A compounded oil having a viscosity equivalent to ISO 3200 was prepared by carrying out formulation in the same manner as in Example 2, except that 28.0% by weight of the copolymer obtained in Polymerization Example 2 and 65.0% by weight of the copolymer obtained in Polymerization Example 1 were used as the ethylene/propylene copolymers (A). Lubricating oil properties of the formulated oil are set forth in Table 4.

Example 4

A formulated oil having a viscosity equivalent to ISO 6800 was prepared by carrying out formulation in the same manner as in Example 2, except that 48.0% by weight of the copolymer obtained in Polymerization Example 2 and 45.0% by weight of the copolymer obtained in Polymerization Example 1 were used as the ethylene/propylene copolymers (A). Lubricating oil properties of the formulated oil are set forth in Table 4.

Example 5

A formulated oil having a viscosity equivalent to ISO 10000 was prepared by carrying out formulation in the same manner as in Example 2, except that 64.0% by weight of the copolymer obtained in Polymerization Example 2 and 29.0% by weight of the copolymer obtained in Polymerization Example 1 were used as the ethylene/propylene copolymers (A). Lubricating oil properties of the formulated oil are set forth in Table 4.

Example 6

A formulated oil having a viscosity equivalent to ISO 22000 was prepared by carrying out formulation in the same manner as in Example 2, except that 83.7% by weight of the copolymer obtained in Polymerization Example 2 and 9.3% by weight of the copolymer obtained in Polymerization Example 1 were used as the ethylene/propylene copolymers (A). Lubricating oil properties of the formulated oil are set forth in Table 4.

Example 7

Using 93.0% by weight of the copolymer obtained in Polymerization Example 2 as the ethylene/propylene copolymer (A), 5.0% by weight of a polyol ester (TMTC available from BFS) and 2.0% by weight of an extreme pressure agent HITEC (trademark)-3339 (available from Afton Chemical Corporation), formulation was carried out to prepare a formulated oil. Lubricating oil properties of the formulated oil are set forth in Table 4.

Example 8

Using 4.0% by weight of the copolymer obtained in Polymerization Example 2 and 84.0% by weight of the copolymer obtained in Polymerization Example 1 as the ethylene/propylene copolymers (A), 10.0% by weight of a poly-α-olefin (NEXBASE 2006 available from Chevron Corporation) as the synthetic oil (D) and 2.0% by weight of an extreme pressure agent HITEC (trademark)-3339 (available from Afton Chemical Corporation), formulation was carried out to prepare a formulated oil having a viscosity equivalent to ISO 1000. Lubricating oil properties of the formulated oil are set forth in Table 4.

Example 9

A formulated oil having a viscosity equivalent to ISO 3200 was prepared by carrying out formulation in the same manner as in Example 8, except that 30.0% by weight of the copolymer obtained in Polymerization Example 2 and 58.0% by weight of the copolymer obtained in Polymerization Example 1 were used as the ethylene/propylene copolymers (A). Lubricating oil properties of the formulated oil are set forth in Table 4.

Example 10

Using 10.0% by weight of the copolymer obtained in Polymerization Example 2 and 73.0% by weight of the copolymer obtained in Polymerization Example 1 as the ethylene/propylene copolymers (A), 10.0% by weight of a poly-α-olefin (NEXBASE 2006 available from Chevron Corporation) and 5.0% by weight of a polyol ester (TMTC available from BFS) as the synthetic oils (D), and 2.0% by weight of an extreme pressure agent HITEC (trademark)-3339 (available from Afton Chemical Corporation), formulation was carried out to prepare a formulated oil having a viscosity equivalent to ISO 1000. Lubricating oil properties of the formulated oil are set forth in Table 4.

Example 11

A formulated oil having a viscosity equivalent to ISO 2200 was prepared by carrying out formulation in the same manner as in Example 10, except that 30.0% by weight of the copolymer obtained in Polymerization Example 2 and 53.0% by weight of the copolymer obtained in Polymerization Example 1 were used as the ethylene/propylene copolymers (A). Lubricating oil properties of the formulated oil are set forth in Table 4.

viscosity poly-α-olefin (DURASYN 180 available from INEOS) as the synthetic oil (C) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 5.

Example 13

A formulated oil having a viscosity equivalent to ISO 3200 was prepared by carrying out formulation in the same manner as in Example 12, except that 27.0% by weight of the ethylene/propylene copolymer obtained in Polymerization Example 2 was used as the ethylene/propylene copolymer (A), and 71.0% by weight of a high-viscosity poly-α-olefin (DURASYN 180 available from INEOS) was used as the synthetic oil (C). Lubricating oil properties of the formulated oil are set forth in Table 5.

Example 14

Using 20.0% by weight of the ethylene/propylene copolymer obtained in Polymerization Example 2 as the ethylene/propylene copolymer (A), 73.0% by weight of a high-viscosity poly-α-olefin (DURASYN 180 available from INEOS) as the synthetic oil (C), 5.0% by weight of a polyol ester (TMTC available from BFS) as the synthetic oil (D) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 5.

Example 15

A formulated oil having a viscosity equivalent to ISO 3200 was prepared by carrying out formulation in the same manner as in Example 14, except that 30.0% by weight of

TABLE 4

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| A-2000 | 0.0 | 9.5 | 28.0 | 48.0 | 64.0 | 83.7 | 93.0 | 4.0 | 30.0 | 10.0 | 30.0 |
| A-100 | 93.0 | 83.5 | 65.0 | 45.0 | 29.0 | 9.3 | 0 | 84.0 | 58.0 | 73.0 | 53.0 |
| Chevron NEXBASE 2006 | | | | | | | | 10.0 | 10.0 | 10.0 | 10.0 |
| BFS TMTC | 5.0 | 5.0 | 5.0 | 5.0 | 5.0 | 5.0 | 5.0 | | | 5.0 | 5.0 |
| HITEC ®3339 | 2.0 | 2.0 | 2.0 | 2.0 | 2.0 | 2.0 | 2.0 | 2.0 | 2.0 | 2.0 | 2.0 |
| 40° C. Kinematic viscosity | 962 | 2010 | 3123 | 6310 | 10900 | 21100 | 27800 | 1090 | 2930 | 1060 | 2300 |
| 100° C. Kinematic viscosity | 80.6 | 151 | 222 | 410 | 711 | 1217 | 1546 | 87.8 | 214 | 91.1 | 181 |
| Viscosity index | 163 | 183 | 198 | 224 | 257 | 277 | 288 | 167 | 199 | 172 | 200 |
| KRL shear viscosity reduction rate (%) | 0 | 6.9 | 9.3 | * | * | * | * | 6.5 | 9.5 | 7.0 | 10.7 |
| Sulfur content | 0.65 | 0.65 | 0.65 | 0.65 | 0.65 | 0.65 | 0.65 | 0.65 | 0.65 | 0.65 | 0.65 |
| Compatibility (appearance) | ○ | ○ | ○ | ○ | ○ | ○ | ○ | ○ | ○ | ○ | ○ |
| Indication of ISO viscosity classification | 1000 | 2200 | 3200 | 6800 | 10000 | 22000 | — | 1000 | 3200 | 1000 | 2200 |

* unmeasurable (attributable to high viscosity)

Example 12

Using 17.5% by weight of the ethylene/propylene copolymer obtained in Polymerization Example 2 as the ethylene/propylene copolymer (A), 80.5% by weight of a highthe ethylene/propylene copolymer obtained in Polymerization Example 2 was used as the ethylene/propylene copolymer (A), and 63.0% by weight of a high-viscosity poly-α-olefin (DURASYN 180 available from INEOS) was used as the synthetic oil (C). Lubricating oil properties of the formulated oil are set forth in Table 5.

Example 16

Using 30.0% by weight of the ethylene/propylene copolymer obtained in Polymerization Example 2 as the ethylene/propylene copolymer (A), 53.0% by weight of a high-viscosity poly-α-olefin (DURASYN 180 available from INEOS) as the synthetic oil (C), 10.0% by weight of a low-viscosity poly-α-olefin (NEXBASE 2006 available from Chevron Corporation) as the synthetic oil (C), 5.0% by weight of a polyol ester (TMTC available from BFS) as the synthetic oil (D) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 5.

Example 17

A formulated oil having a viscosity equivalent to ISO 3200 was prepared by carrying out formulation in the same manner as in Example 16, except that 40.0% by weight of the ethylene/propylene copolymer obtained in Polymerization Example 2 was used as the ethylene/propylene copolymer (A), and 43.0% by weight of a high-viscosity poly-α-olefin (DURASYN 180 available from INEOS) was used as the synthetic oil (C). Lubricating oil properties of the formulated oil are set forth in Table 5.

Example 18

Using 20.0% by weight of the ethylene/propylene copolymer obtained in Polymerization Example 2 as the ethylene/propylene copolymer (A), 78.0% by weight of bright stock (N460 available from JX) as the mineral oil (E) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 5.

Example 19

A formulated oil having a viscosity equivalent to ISO 4600 was prepared by carrying out formulation in the same manner as in Example 18, except that 40.0% by weight of the ethylene/propylene copolymer obtained in Polymerization Example 2 was used as the ethylene/propylene copolymer (A), and 58.0% by weight of bright stock (N460 available from JX) was used as the mineral oil (E). Lubricating oil properties of the formulated oil are set forth in Table 5.

Example 20

A formulated oil having a viscosity equivalent to ISO 10000 was prepared by carrying out formulation in the same manner as in Example 18, except that 60.0% by weight of the copolymer obtained in Polymerization Example 2 was used as the ethylene/propylene copolymer (A), and 38.0% by weight of bright stock (N460 available from JX) was used as the mineral oil (E). Lubricating oil properties of the formulated oil are set forth in Table 5.

Example 21

Using 50.0% by weight of the copolymer obtained in Polymerization Example 2 as the ethylene/propylene copolymer (A), 38% by weight of a polyol ester (PRIOLUBE 3986 available from UNICHEMA) as the synthetic oil (C), 10.0% by weight of a low-viscosity poly-α-olefin (NEXBASE 2006 available from Chevron Corporation) as the synthetic oil (D) and 2.0% by weight of an extreme pressure agent HITEC (trademark)-3339 (available from Afton Chemical Corporation), formulation was carried out to prepare a formulated oil having a viscosity equivalent to ISO 3200. Lubricating oil properties of the formulated oil are set forth in Table 5.

TABLE 5

| | Ex. 12 | Ex. 13 | Ex. 14 | Ex. 15 | Ex. 16 | Ex. 17 | Ex. 18 | Ex. 19 | Ex. 20 | Ex. 21 |
|---|---|---|---|---|---|---|---|---|---|---|
| A-2000 | 17.5 | 27.0 | 20.0 | 30.0 | 30.0 | 40.0 | 20.0 | 40.0 | 60.0 | 50.0 |
| Ineos DURASYN-180 | 80.5 | 71.0 | 73.0 | 63.0 | 53.0 | 43.0 | | | | |
| JX bright stock N460 | | | | | | | 78.0 | 58.0 | 38.0 | |
| UNICHEMA PRIOLUBE3986 | | | | | | | | | | 38.0 |
| Chevron NEXBASE 2006 | | | | | 10.0 | 10.0 | | | | 10.0 |
| BFS TMTC | | | 5.0 | 5.0 | 5.0 | 5.0 | | | | |
| HITEC ®3339 | 2.0 | 2.0 | 2.0 | 2.0 | 2.0 | 2.0 | 2.0 | 2.0 | 2.0 | 2.0 |
| 40° C. Kinematic viscosity | 2050 | 3260 | 2040 | 3070 | 2120 | 3150 | 2120 | 4570 | 10700 | 3438 |
| 100° C. Kinematic viscosity | 152 | 229 | 159 | 224 | 173 | 295 | 126 | 263 | 580 | 269 |
| Viscosity index | 183 | 201 | 189 | 201 | 213 | 244 | 151 | 187 | 228 | 219 |
| KRL shear viscosity reduction rate (%) | 9.6 | 10.4 | 9.8 | 10.6 | 10.7 | 11.1 | 9.7 | 9.7 | * | 12.0 |
| Sulfur content | 0.65 | 0.65 | 0.65 | 0.65 | 0.65 | 0.65 | 0.65 | 0.65 | 0.65 | 0.65 |
| Compatibility (appearance) | ○ | ○ | ○ | ○ | ○ | ○ | ○ | ○ | ○ | ○ |
| Indication of ISO viscosity classification | 2200 | 3200 | 2200 | 3200 | 2200 | 3200 | 2200 | 4600 | 10000 | 3200 |

* unmeasurable (attributable to high viscosity)

Comparative Example 1

Using 20.0% by weight of polybutene (HV-1900 available from JX) as a viscosity modifier, 78.0% by weight of the copolymer of Polymerization Example 1 as the ethylene/propylene copolymer (A) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 6.

Comparative Example 2

A formulated oil having a viscosity equivalent to ISO 6800 was prepared by carrying out formulation in the same manner as in Comparative Example 1, except that 42.0% by weight of polybutene (HV-1900 available from JX) was used, and 56.0% by weight of the copolymer of Polymerization Example 1 was used as the ethylene/propylene copolymer (A). Lubricating oil properties of the formulated oil are set forth in Table 6.

Comparative Example 3

A formulated oil having a viscosity equivalent to ISO 10000 was prepared by carrying out formulation in the same manner as in Comparative Example 1, except that 50.0% by weight of polybutene (HV-1900 available from JX) was used, and 48.0% by weight of the copolymer of Polymerization Example 1 was used as the ethylene/propylene copolymer (A). Lubricating oil properties of the formulated oil are set forth in Table 6.

Comparative Example 4

Using 20.0% by weight of polybutene (HV-1900 available from JX), 73.0% by weight of the copolymer of Polymerization Example 1 as the ethylene/propylene copolymer (A), 5.0% by weight of a polyol ester (TMTC available from BFS) as the synthetic oil (D) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 6.

Comparative Example 5

A formulated oil having a viscosity equivalent to ISO 4600 was prepared by carrying out formulation in the same manner as in Comparative Example 4, except that 40.0% by weight of polybutene (HV-1900 available from JX) was used, and 53.0% by weight of the copolymer of Polymerization Example 1 was used as the ethylene/propylene copolymer (A). Lubricating oil properties of the formulated oil are set forth in Table 6.

Comparative Example 6

A formulated oil having a viscosity equivalent to ISO 10000 was prepared by carrying out formulation in the same manner as in Comparative Example 4, except that 55.0% by weight of polybutene (HV-1900 available from JX) was used, and 38.0% by weight of the copolymer of Polymerization Example 1 was used as the ethylene/propylene copolymer (A). Lubricating oil properties of the formulated oil are set forth in Table 6.

Comparative Example 7

Using 15.0% by weight of polybutene (HV-1900 available from JX), 68.0% by weight of the copolymer of Polymerization Example 1 as the ethylene/propylene copolymer (A), 10.0% by weight of a low-viscosity poly-α-olefin (NEXBASE 2006 available from Chevron Corporation) and 5.0% by weight of a polyol ester (TMTC available from BFS) as the synthetic oils (D), and 2.0% by weight of an extreme pressure agent HITEC (trademark)-3339 (available from Afton Chemical Corporation), formulation was carried out to prepare a formulated oil having a viscosity equivalent to ISO 1000. Lubricating oil properties of the formulated oil are set forth in Table 6.

Comparative Example 8

A formulated oil having a viscosity equivalent to ISO 3200 was prepared by carrying out formulation in the same manner as in Comparative Example 7, except that 40.0% by weight of polybutene (HV-1900 available from JX) was used, and 43.0% by weight of the copolymer of Polymerization Example 1 was used as the ethylene/propylene copolymer (A). Lubricating oil properties of the formulated oil are set forth in Table 6.

Comparative Example 9

A formulated oil having a viscosity equivalent to ISO 10000 was prepared by carrying out formulation in the same manner as in Comparative Example 7, except that 65.0% by weight of polybutene (HV-1900 available from JX) was used, and 18.0% by weight of the copolymer of Polymerization Example 1 was used as the ethylene/propylene copolymer (A). Lubricating oil properties of the formulated oil are set forth in Table 6.

Comparative Example 10

Using 98.0% by weight of bright stock (N460 available from JX) and 2.0% by weight of an extreme pressure agent HITEC (trademark)-3339 (available from Afton Chemical Corporation), formulation was carried out to prepare a formulated oil having a viscosity equivalent to ISO 460. Lubricating oil properties of the formulated oil are set forth in Table 6.

Comparative Example 11

Using 23.0% by weight of SV-251 (available from Shell Chemicals, styrene-based block copolymer) as a viscosity modifier, 75.0% by weight of the copolymer of Polymerization Example 1 as the ethylene/propylene copolymer (A) and 2.0% by weight of an extreme pressure agent HITEC (trademark)-3339 (available from Afton Chemical Corporation), formulation was carried out to prepare a formulated oil having a viscosity equivalent to ISO 2200. Lubricating oil properties of the formulated oil are set forth in Table 6.

TABLE 6

| | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 | Comp. Ex. 11 |
|---|---|---|---|---|---|---|---|---|---|---|---|
| JX HV1900 | 20.0 | 42.0 | 50.0 | 20.0 | 40.0 | 55.0 | 14.0 | 40.0 | 65.0 | | |
| Shell Chemicals SV251 | | | | | | | | | | | 23.0 |
| A-100 | 78.0 | 56.0 | 48.0 | 73.0 | 53.0 | 38.0 | 69.0 | 43.0 | 18.0 | | 75.0 |
| JX bright stock N460 | | | | | | | | | | 98.0 | |
| Chevron | | | | | | | 10.0 | 10.0 | 10.0 | | |
| NEXBASE 2006 | | | | | | | | | | | |
| BFS TMTC | | | | 5.0 | 5.0 | 5.0 | 5.0 | 5.0 | 5.0 | | |
| HITEC ®3339 | 2.0 | 2.0 | 2.0 | 2.0 | 2.0 | 2.0 | 2.0 | 2.0 | 2.0 | 2.0 | 2.0 |
| 40° C. Kinematic viscosity | 2390 | 6840 | 10100 | 1990 | 4690 | 10400 | 1080 | 3250 | 10700 | 422 | 2210 |
| 100° C. Kinematic viscosity | 149 | 298 | 399 | 132 | 241 | 407 | 84.1 | 182 | 407 | 28.0 | 178 |
| Viscosity index | 145 | 169 | 177 | 163 | 171 | 176 | 157 | 164 | 174 | 92 | 200 |
| KRL shear viscosity reduction rate (%) | 13.0 | * | * | 13.5 | 14.5 | * | 12.2 | 14.7 | * | 0.3 | >30 |
| Sulfur content | 0.7 | 0.7 | 0.7 | 0.7 | 0.7 | 0.7 | 0.7 | 0.7 | 0.7 | 0.7 | 0.7 |
| Compatibility (appearance) | ○ | ○ | ○ | ○ | ○ | ○ | ○ | ○ | ○ | ○ | ○ |
| Indication of ISO viscosity classification | 2200 | 6800 | 10000 | 2200 | 4600 | 10000 | 1000 | 3200 | 10000 | 460 | 2200 |

* unmeasurable (attributable to high viscosity)

Comparative Example 12

A formulated oil having a viscosity equivalent to ISO 1000 was prepared by carrying out formulation in the same manner as in Example 1, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 13

A formulated oil having a viscosity equivalent to ISO 2200 was prepared by carrying out formulation in the same manner as in Example 2, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 14

A formulated oil having a viscosity equivalent to ISO 3200 was prepared by carrying out formulation in the same manner as in Example 3, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 15

A formulated oil having a viscosity equivalent to ISO 6800 was prepared by carrying out formulation in the same manner as in Example 4, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 16

A formulated oil having a viscosity equivalent to ISO 10000 was prepared by carrying out formulation in the same manner as in Example 5, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 17

A formulated oil having a viscosity equivalent to ISO 22000 was prepared by carrying out formulation in the same manner as in Example 6, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 18

A formulated oil was prepared by carrying out formulation in the same manner as in Example 7, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 19

A formulated oil having a viscosity equivalent to ISO 1000 was prepared by carrying out formulation in the same manner as in Example 8, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 20

A formulated oil having a viscosity equivalent to ISO 3200 was prepared by carrying out formulation in the same manner as in Example 9, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 21

A formulated oil having a viscosity equivalent to ISO 1000 was prepared by carrying out formulation in the same manner as in Example 10, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

Comparative Example 22

A formulated oil having a viscosity equivalent to ISO 2200 was prepared by carrying out formulation in the same manner as in Example 11, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 7.

TABLE 7

| | Comp. Ex. 12 | Comp. Ex. 13 | Comp. Ex. 14 | Comp. Ex. 15 | Comp. Ex. 16 | Comp. Ex. 17 | Comp. Ex. 18 | Comp. Ex. 19 | Comp. Ex. 20 | Comp. Ex. 21 | Comp. Ex. 22 |
|---|---|---|---|---|---|---|---|---|---|---|---|
| A-2000 | — | 9.5 | 28.0 | 48.0 | 65.0 | 83.7 | 93.0 | 4.0 | 30.0 | 10.0 | 30.0 |
| A-100 | 93.0 | 83.5 | 65.0 | 45.0 | 35.0 | 9.3 | — | 84.0 | 58.0 | 73.0 | 53.0 |
| Chevron NEXBASE 2006 | | | | | | | | 10.0 | 10.0 | 10.0 | 10.0 |
| BFS TMTC | 5.0 | 5.0 | 5.0 | 5.0 | 5.0 | 5.0 | 5.0 | | | 5.0 | 5.0 |
| HITEC ®343 | 2.0 | 2.0 | 2.0 | 2.0 | 2.0 | 2.0 | 2.0 | 2.0 | 2.0 | 2.0 | 2.0 |
| Compatibility (appearance) | X | X | X | X | X | X | X | X | X | X | X |
| Indication of ISO viscosity classification | 1000 | 2200 | 3200 | 6800 | 10000 | 22000 | — | 1000 | 3200 | 1000 | 2200 |

Comparative Example 23

A formulated oil having a viscosity equivalent to ISO 2200 was prepared by carrying out formulation in the same manner as in Example 12, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 24

A formulated oil having a viscosity equivalent to ISO 3200 was prepared by carrying out formulation in the same manner as in Example 13, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 25

A formulated oil having a viscosity equivalent to ISO 2200 was prepared by carrying out formulation in the same manner as in Example 14, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 26

A formulated oil having a viscosity equivalent to ISO 3200 was prepared by carrying out formulation in the same manner as in Example 15, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 27

A formulated oil having a viscosity equivalent to ISO 2200 was prepared by carrying out formulation in the same manner as in Example 16, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 28

A formulated oil having a viscosity equivalent to ISO 3200 was prepared by carrying out formulation in the same manner as in Example 17, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 29

A formulated oil having a viscosity equivalent to ISO 2200 was prepared by carrying out formulation in the same manner as in Example 18, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 30

A formulated oil having a viscosity equivalent to ISO 4600 was prepared by carrying out formulation in the same manner as in Example 19, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

Comparative Example 31

A formulated oil having a viscosity equivalent to ISO 10000 was prepared by carrying out formulation in the same manner as in Example 20, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 8.

TABLE 8

| | Comp. Ex. 23 | Comp. Ex. 24 | Comp. Ex. 25 | Comp. Ex. 26 | Comp. Ex. 27 | Comp. Ex. 28 | Comp. Ex. 29 | Comp. Ex. 30 | Comp. Ex. 31 |
|---|---|---|---|---|---|---|---|---|---|
| Compounding conditions | | | | | | | | | |
| A-2000 | 17.5 | 27.0 | 20.0 | 30.0 | 30.0 | 40.0 | 20.0 | 40.0 | 60.0 |
| Ineos DURASYN-180 | 80.5 | 71.0 | 73.0 | 63.0 | 53.0 | 43.0 | | | |
| JX bright stock N460 UNICHEMA PRIOLUBE3986 | | | | | | | 78.0 | 58.0 | 38.0 |
| Chevron NEXBASE 2006 | | | | | 10.0 | 10.0 | | | |
| BFS TMTC | | | 5.0 | 5.0 | 5.0 | 5.0 | | | |
| HITEC ®343 | 2.0 | 2.0 | 2.0 | 2.0 | 2.0 | 2.0 | 2.0 | 2.0 | 2.0 |
| Compatibility (appearance) | X | X | X | X | X | X | X | X | X |
| Indication of ISO viscosity classification | 2200 | 3200 | 2200 | 3200 | 2200 | 3200 | 2200 | 4600 | 10000 |

Comparative Example 32

A formulated oil having a viscosity equivalent to ISO 2200 was prepared by carrying out formulation in the same manner as in Comparative Example 1, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 33

A formulated oil having a viscosity equivalent to ISO 6800 was prepared by carrying out formulation in the same manner as in Comparative Example 2, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 34

A formulated oil having a viscosity equivalent to ISO 10000 was prepared by carrying out formulation in the same manner as in Comparative Example 3, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 35

A formulated oil having a viscosity equivalent to ISO 2200 was prepared by carrying out formulation in the same manner as in Comparative Example 4, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 36

A formulated oil having a viscosity equivalent to ISO 4600 was prepared by carrying out formulation in the same manner as in Comparative Example 5, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 37

A formulated oil having a viscosity equivalent to ISO 10000 was prepared by carrying out formulation in the same manner as in Comparative Example 6, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 38

A formulated oil having a viscosity equivalent to ISO 1000 was prepared by carrying out formulation in the same manner as in Comparative Example 7, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 39

A formulated oil having a viscosity equivalent to ISO 3200 was prepared by carrying out formulation in the same manner as in Comparative Example 8, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 40

A formulated oil having a viscosity equivalent to ISO 10000 was prepared by carrying out formulation in the same manner as in Comparative Example 9, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 41

A formulated oil having a viscosity equivalent to ISO 460 was prepared by carrying out formulation in the same manner as in Comparative Example 10, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

Comparative Example 42

A formulated oil having a viscosity equivalent to ISO 2200 was prepared by carrying out formulation in the same manner as in Comparative Example 11, except that as the extreme pressure agent, HITEC (trademark)-3339 (available from Afton Chemical Corporation) was replaced with HITEC (trademark) 343 (available from the same company). The result of compatibility evaluation of the formulated oil is set forth in Table 9.

The invention claimed is:

1. A lubricating oil composition comprising (A) an ethylene/α-olefin copolymer satisfying all of the following requirements (A-1) to (A-3):

(A-1) an ethylene structural unit content is 30 to 70% by mol, (A-2) a kinematic viscosity at 100° C. is 20 to 3000 $mm^2/s$, and (A-3) Mw/Mn as measured by GPC is 1 to 2.5, (F) a sulfur-containing compound in which at least one hydrocarbon group adjacent to sulfur is a secondary or tertiary hydrocarbon group, and as an optional component, (G) an α-olefin polymer having 3 to 6 carbon atoms, and having a kinematic viscosity at 40° C. of 450 to 51,000 $mm^2/s$, a sulfur content of 0.1 to 5 parts by weight, and a component (G) content of 0 to 15 parts by weight, with the proviso that the total amount of the lubricating oil composition is 100 parts by weight.

2. The lubricating oil composition as claimed in claim 1, which further comprises a component (B) satisfying all of the following requirements (B-1) to (B-3):

(B-1) a kinematic viscosity at 100° C. is 3 to 120 $mm^2/s$, (B-2) a viscosity index is not less than 90, and (B-3) a pour point is not higher than −10° C.

3. The lubricating oil composition as claimed in claim 2, wherein the component (B) is synthetic oil (C) satisfying all of the following requirements (C-1) to (C-3):

(C-1) a kinematic viscosity at 100° C. is 20 to 120 $mm^2/s$, (C-2) a viscosity index is not less than 120, and (C-3) a pour point is not higher than −30° C.

4. The lubricating oil composition as claimed in claim 2, wherein the component (B) is synthetic oil (D) satisfying all of the following requirements (D-1) to (D-3):

(D-1) a kinematic viscosity at 100° C. is 3 to 10 $mm^2/s$, (D-2) a viscosity index is not less than 120, and (D-3) a pour point is not higher than −40° C.

5. The lubricating oil composition as claimed in claim 2, wherein the component (B) is mineral oil (E) satisfying all of the following requirements (E-1) to (E-3):

(E-1) a kinematic viscosity at 100° C. is 3 to 40 $mm^2/s$, (E-2) a viscosity index is not less than 90, and (E-3) a pour point is not higher than −10° C.

6. The lubricating oil composition as claimed in claim 3, wherein the component (C) and/or the component (D) is synthetic oil comprising an α-olefin polymer having 8 to 20 carbon atoms and/or an ester compound.

7. The lubricating oil composition as claimed in claim 5, wherein the component (E) is one or more mineral oils selected from Groups (I), (II) and (III) of the API classification.

TABLE 9

| | Comp. Ex. 32 | Comp. Ex. 33 | Comp. Ex. 34 | Comp. Ex. 35 | Comp. Ex. 36 | Comp. Ex. 37 | Comp. Ex. 38 | Comp. Ex. 39 | Comp. Ex. 40 | Comp. Ex. 41 | Comp. Ex. 42 |
|---|---|---|---|---|---|---|---|---|---|---|---|
| JX HV1900 | 20.0 | 42.0 | 50.0 | 20.0 | 40.0 | 55.0 | 15.0 | 40.0 | 65.0 | | |
| Shell Chemicals SV251 | | | | | | | | | | | 23.0 |
| A-100 | 78.0 | 56.0 | 48.0 | 73.0 | 53.0 | 38.0 | 68.0 | 43.0 | 18.0 | | 75.0 |
| JX bright stock N460 | | | | | | | | | | 98.0 | |
| Chevron NEXBASE 2006 | | | | | | | 10.0 | 10.0 | 10.0 | | |
| BFS TMTC | | | | 5.0 | 5.0 | 5.0 | 5.0 | 5.0 | 5.0 | | |
| HITEC ®343 | 2.0 | 2.0 | 2.0 | 2.0 | 2.0 | 2.0 | 2.0 | 2.0 | 2.0 | 2.0 | 2.0 |
| Compatibility (appearance) | X | X | X | X | X | X | X | X | X | ○ | X |
| Indication of ISO viscosity classification | 2200 | 6800 | 10000 | 2200 | 4600 | 10000 | 1000 | 3200 | 10000 | 460 | 2200 |

8. The lubricating oil composition as claimed in claim 1, wherein a saturated hydrocarbon content based on the total amount of the components (A) to (E) is not less than 80% by weight.

9. The lubricating oil composition as claimed in claim 1, which is a gear oil composition.

* * * * *